US007520745B2

(12) United States Patent
Oomens et al.

(10) Patent No.: US 7,520,745 B2
(45) Date of Patent: Apr. 21, 2009

(54) BURNER FOR A GAS TURBINE

(75) Inventors: Gijsbertus Oomens, Nussbaumen (CH); Bettina Paikert, Oberrohrdorf (CH); Peter Flohr, Turgi (CH); Christian Steinbach, Birmenstorf (CH)

(73) Assignee: ALSTOM Technology Ltd., Baden (CH)

( * ) Notice: Subject to any disclaimer, the term of this patent is extended or adjusted under 35 U.S.C. 154(b) by 0 days.

(21) Appl. No.: 11/689,655

(22) Filed: Mar. 22, 2007

(65) Prior Publication Data

US 2007/0207431 A1 Sep. 6, 2007

Related U.S. Application Data

(63) Continuation of application No. PCT/EP2005/055098, filed on Oct. 7, 2005.

(30) Foreign Application Priority Data

Oct. 18, 2004 (CH) ..... 04/1710

(51) Int. Cl.
*F23D 14/62* (2006.01)
*F23D 14/46* (2006.01)

(52) U.S. Cl. ..... 431/354; 431/350

(58) Field of Classification Search ..... 431/354, 431/351, 9, 8, 185, 11, 12, 253, 350; 60/748
See application file for complete search history.

(56) References Cited

U.S. PATENT DOCUMENTS 5,586,878 A * 12/1996 Dobbeling et al. ..... 431/451
6,102,692 A * 8/2000 Dobbeling et al. ..... 431/350
6,270,338 B1 * 8/2001 Eroglu et al. ..... 431/8
6,331,109 B1 * 12/2001 Paikert et al. ..... 431/350

(Continued)

FOREIGN PATENT DOCUMENTS

DE 4440558 5/1996

(Continued)

OTHER PUBLICATIONS

Search Report for Swiss Patent App. No. 1710/2004 (Jan. 25, 2005).

(Continued)

*Primary Examiner*—Kenneth B Rinehart
*Assistant Examiner*—Chuka C Ndubizu
(74) *Attorney, Agent, or Firm*—Cermak Kenealy Vaidya & Nakajima LLP; Adam J. Cermak

(57) ABSTRACT

A premix burner, for example for a gas turbine, having a conical swirl generator (1) and a cylindrical mixing section (2) which follows it in the direction of flow, includes a high-pressure atomizer nozzle (10) with one or more fuel feed passages. The high-pressure atomizer nozzle (10) includes at least two outlet passages, through which liquid fuel enters the swirl generator (1), these passages being arranged off-center with respect to the longitudinal axis of the nozzle and being configured in such a way that the spray cone (11) of the fuel is oriented at an angle (β) with respect to the longitudinal axis of the swirl generator (1) which is smaller than the cone half-angle (α) of the swirl generator (1). The outlet passages in particular have an internal geometry with a conically narrowed section.

16 Claims, 4 Drawing Sheets

U.S. PATENT DOCUMENTS 6,378,310 B1 * 4/2002 Le Gal et al. ..... 60/760

FOREIGN PATENT DOCUMENTS

| | | |
|---|---|---|
| DE | 19536837 | 4/1997 |
| DE | 19730617 | 1/1999 |
| DE | 10355930 | 7/2004 |
| EP | 0899508 | 3/1999 |
| EP | 0902233 | 3/1999 |
| EP | 0918191 | 5/1999 |
| EP | 0924461 | 6/1999 |
| WO | WO2006/042796 | 4/2006 |

OTHER PUBLICATIONS

International Search Report for PCT App. No. PCT/EP2005/055098 (Jun. 19, 2006).

* cited by examiner

BURNER FOR A GAS TURBINE

This application is a Continuation of, and claims priority under 35 U.S.C. § 120 to, International application number PCT/EP2005/055098, filed 7 Oct. 2005, and claims priority therethrough to Swiss application number 01710/04, filed 18 Oct. 2004, the entireties of which are incorporated by reference herein.

BACKGROUND

1. Field of Endeavor

The disclosure relates to a premix burner for a gas turbine, in particular to a nozzle for atomising liquid fuel in a premix burner with a conical swirl generator and a subsequent cylindrical mixing section.

2. Brief Description of the Related Art

Premix burners with a conical swirl generator and a subsequent cylindrical mixing section are known, for example, from EP918191. The swirl generator, which serves as a premix section, has conical interleaved sections, the longitudinal axes of which are in each case offset with respect to one another. Compressed combustion air passes through tangential inflow passages between the walls of the conical sections into the mixing space of the swirl generator. A fuel is introduced via one or more nozzles or alternatively via fuel lines along the tangential air inflow passages into the mixing space, where it is mixed with the air. Further premixing of air and fuel is achieved in the subsequent mixing section, in that the latter produces high-quality mixing on account of the flows being routed without any losses. The mixing section also performs the function of preventing flashback of the flame from the combustion chamber into which the mixing section expands.

A further premix burner of this type is disclosed in DE 103 55 930. The outlet region of the mixing section is, in that case, provided with undulations which generate axial swirls and as a result influence the turbulence in the outlet region and the flow stability. The fuel is introduced axially via a nozzle into the conical swirl generator, with the nozzle opening lying on the longitudinal axis of the premix burner.

DE 197 30 617 discloses a two-stage pressure atomiser nozzle for use in combustion technology with two coaxial tubes and a mixing chamber into which two feed passages lead. A nozzle outlet bore lies on the axis of the nozzle tubes and has a diameter which is in a given ratio to the diameter of the feed passages.

DE 44 40 558 discloses a premix burner with a conical swirl generator. The fuel is introduced via a nozzle with openings which do not lie on the longitudinal axis of the nozzle. The angle between the resulting spray cones and the longitudinal axis of the nozzle is in particular larger than the divergence angle of the conical part of the swirl generator. The abovementioned fuel nozzle is designed specifically for a premix burner without a cylindrical mixing section.

EP 899 508 discloses a premix burner with a swirl generator having a cylindrically formed mixing section as described in the introduction, and in particular a fuel nozzle with nozzle tubes 104 which each generate a fuel jet with an injection angle with respect to the central axis of the fuel nozzle which is equal to the divergence angle of the cone of the swirl generator.

EP 902233 discloses a combined pressure atomiser nozzle for a gas turbine burner with swirl generator, the nozzle body of which has two separate feed passages, from each of which an outlet opening leads into the mixing space of the burner. The nozzle body therefore has two different nozzles, namely:

a radially outer multi-hole nozzle with outlet openings arranged off-center; and a central nozzle, lying on the longitudinal axis, with a centrally arranged outlet opening. The outlet openings arranged off-center are positioned in such a way that the spray cones are directed into the wake of the cone shells of the swirl generator. At full load, this nozzle is operated by way of the outlet openings positioned off-center. At partial load, the nozzle is switched over to the central outlet openings, in order to prevent drops of fuel oil being deposited on the walls of the swirl generator.

DE 19536837 discloses an apparatus for injecting fuels having a swirl chamber within the injection apparatus or nozzle. An axially running air feed passage 5 and a fuel passage 2 which runs parallel to the longitudinal axis of the nozzle lead into this swirl chamber 1, in which air and fuel in a first phase are mixed while they are still inside the nozzle. As seen in the direction of flow, the swirl chamber has a conically narrowed section, through which the air/fuel mix flows, ultimately passing via an outlet opening lying on the longitudinal axis of the nozzle into a burner mixing space. The only outlet opening from the nozzle is arranged on the longitudinal axis of the nozzle.

SUMMARY

Among numerous aspects of the present invention is an aspect including providing a suitable high-pressure atomiser nozzle for a premix burner of the type described in the introduction with conical swirl generator and subsequent cylindrical mixing section, which opens out into a combustion chamber, and openings for an incoming flow of air along the conical parts of the swirl generator. In particular, taking the abovementioned prior art into consideration, the nozzle is to be further developed in such a way that

- a droplet size distribution of the atomised liquid fuel which allows complete vaporisation of the droplets, before it enters the combustion chamber for combustion, is achieved,
- a sufficient depth of penetration of the fuel droplets in the mixing space of the premix burner is ensured,
- low levels of pollutant emissions, in particular of $NO_x$ emissions, are achieved by virtue of the first two properties,
- as far as possible no droplets reach the walls of the premix burner.

For the abovementioned premix burner, another aspect of the present invention includes a high-pressure atomiser nozzle which includes one or more fuel passages for feeding liquid fuel into an interior space of the nozzle, the liquid fuel being at a pressure of more than 50 bar at full load. The high-pressure atomiser nozzle has at least two outlet passages and outlet openings, through which the liquid fuel emerges from a single interior space in the nozzle into the mixing space of the swirl generator, the outlet passages being arranged off-center with respect to the longitudinal axis of the nozzle, so that the spray cone which emerges is directed onto the wake of the individual cone shells. According to the invention, the outlet passages and outlet openings of the nozzle are arranged and designed in such a way that the spray cones which emerge from the outlet openings have a longitudinal axis running at an angle with respect to the longitudinal axis of the swirl generator and of the mixing section which is smaller than the cone half-angle of the swirl generator.

The arrangement of the outlet openings in the aforementioned angle range in accordance with principles of the present invention, provides the advantage that the fuel droplets do not reach the wall of the premix burner, and coking of fuel oil droplets on the walls of the swirl generator is avoided. An additional benefit is that the fuel cone comes into contact with the air flowing in between the cone parts of the swirl generator at a shearing angle which is small enough for the atomised fuel stream to retain a high velocity and thus to achieve a great depth of penetration into the premix burner and into the combustion chamber. An excessively large orientation angle of the spray cones with respect to the longitudinal axis of the swirl generator, on the other hand, would lead to the atomised fuel coming into contact with the incoming air flow at an earlier stage and being diverted toward the center of the swirl generator by the air flow. Orienting the outlet openings at the abovementioned angle with respect to the longitudinal axis of the premix burner, together with the high pressure of the fuel, leads to a second atomisation, i.e., a very high degree of atomisation, being achieved on top of the first atomisation at the nozzle outlet, resulting in small droplet sizes and rapid vaporisation. These features of the atomisation lead to direct mixing of the fuel with the compressed air in the cone part of the premix burner and to good, homogenous mixing with the compressed combustion air at the end of the mixing section. These features overall lead to low pollutant emission levels.

In a preferred embodiment of the invention, the outlet passages are oriented in such a way that the longitudinal axes of the individual spray cones which result run at an angle with respect to the longitudinal axis of the swirl generator which is smaller than the half-angle of the cone shells and greater than 10°. In one specific embodiment, this angle is in a range from 10° to 18°.

A minimum value for this angle ensures that the fuel spray cone does not come too close to the center of the swirl generator. This is because if the atomised fuel comes too close to the center, higher pollutant emission levels result for the premix burner.

In a further preferred embodiment, the nozzle has a feed passage for fuel in its interior, leading into a single interior space of the nozzle. This interior space is connected to the interior space of the swirl generator via the at least two outlet passages. The at least two outlet passages of the nozzle are preferably arranged in the radially outer half with respect to the longitudinal axis of the nozzle. The result of this is that less fuel passes into the center of the swirl generator. It is expedient for the openings to be positioned symmetrically with respect to the longitudinal or center axis of the nozzle, so that overall an axially symmetrical hollow spray cone is formed. The orientation of the individual spray cones is once again at an angle which is smaller than the cone angle of the swirl generator.

In a further preferred embodiment of the invention, the high-pressure atomiser nozzle and in particular its outlet passages have a specific internal geometry which contributes to the desired stability of the spray cone and penetration depths. For this purpose, the nozzle has outlet passages which lead from its interior space through the nozzle wall into the interior space of the swirl generator, the outlet passages, as seen in the direction of flow, having a first cylindrical section, a conically narrowed section and finally a second cylindrical section. The narrowed section in this case is at a predetermined angle with respect to the longitudinal axis of the outlet passage. It is preferable for this half-angle of the conically narrowed section to be less than 45°. The longitudinal axes of the outlet passages in each case run at an angle with respect to the nozzle longitudinal axis which is smaller than the half-angle of the cone parts of the swirl generator. The internal geometry of the outlet passages produces the advantage of avoiding turbulence and cavitation effects.

The high-pressure atomiser nozzle according to the invention differs from the prior art, for example from EP 9022333, by virtue of the fact that the nozzle is overall of greatly simplified design. Its interior space includes only a single interior chamber, which leads to reduced turbulence at the nozzle outlet and a more stable spray cone. It merely has a group of outlet openings through which the liquid fuel is sprayed for all the different operating situations and loads. For this purpose, however, the outlet openings have the specific internal geometry and orientation with respect to the longitudinal axis of the premix burner in accordance with the invention.

In a first specific and preferred embodiment, the outlet passages include tubes which lead from the interior space of the nozzle through its wall and extend beyond the surface of the nozzle. In a first variant, the tubes are of a length such that they only project beyond the surface of the nozzle but are shorter than the nozzle tip. In a further variant, they extend beyond the tip of the nozzle.

In a second specific embodiment, the outlet passage with the above-mentioned cylindrical sections and conically narrowed sections lead from the interior space of the nozzle through the wall, with the outlet opening lying on the outer surface of the nozzle. In this embodiment, the outer wall of the nozzle tip is conical in shape.

The internal geometry of the outlet passages, and in particular the narrowing by a given angle prior to the outlet opening into the swirled generator, reduce turbulence in the spray cone and produce a smaller angle at which the spray cone diverges. This makes it possible to produce a spray cone with a more uniform velocity profile. Finally, the increased flow stability in the spray cone leads to improved positioning of the fuel in the premix burner and therefore to improved flame conditions.

In a further embodiment, the second cylindrical sections of the outlet passages each have a length which amounts to at most five times the diameter of the outlet openings. A length to diameter ratio of this type contributes to improving the flow profile and flow stability. In one specific embodiment, the outlet openings have a diameter of 0.5-1.5 mm.

In a further preferred embodiment of the invention, together with the above-mentioned internal geometries of the outlet passages of the nozzle, the outer wall of the nozzle tip is rounded in form, preferably oval in cross section. The rounded form produces further benefits with regard to the incoming flow of air, since the air flow can uniformly follow this shape of the outer wall of the nozzle, and correspondingly less turbulence or recirculation is produced downstream of the nozzle. This increases the homogeneity of the mixing of air and fuel, which lowers the $NO_x$ emission levels.

A reduced recirculation downstream of the nozzle finally also influences the swirl at the end of the cylindrical mixing section and leads to aerodynamic stabilizing of the flame in the combustion chamber. Stabilizing of this nature allows a greater freedom of choice with regard to the operating parameters of the burner.

In a variant of the invention, the premix burner has further openings for the admission of compressed air in the cylinder wall of the mixing section which follows the swirl generator, as seen in the direction of flow.

In a further variant, the premix burner has further air inlet passages, which run directly along the high-pressure atomiser nozzle, where they pass air into the mixing space of the swirl generator. This measure means that a recirculation zone is only formed downstream of the mixing section, which further stabilises the flame.

The high-pressure atomiser nozzle according to the invention is suitable not only for use in a premix burner with swirl generator with a downstream mixing section, but also for a premix burner with swirl generator on its own without a mixing section. In an application of this type, the high-pressure atomiser nozzle is arranged in such a way that its tip extends as far as or beyond half the length of the swirl generator.

DETAILED DESCRIPTION OF EXEMPLARY EMBODIMENTS

Figure 1:
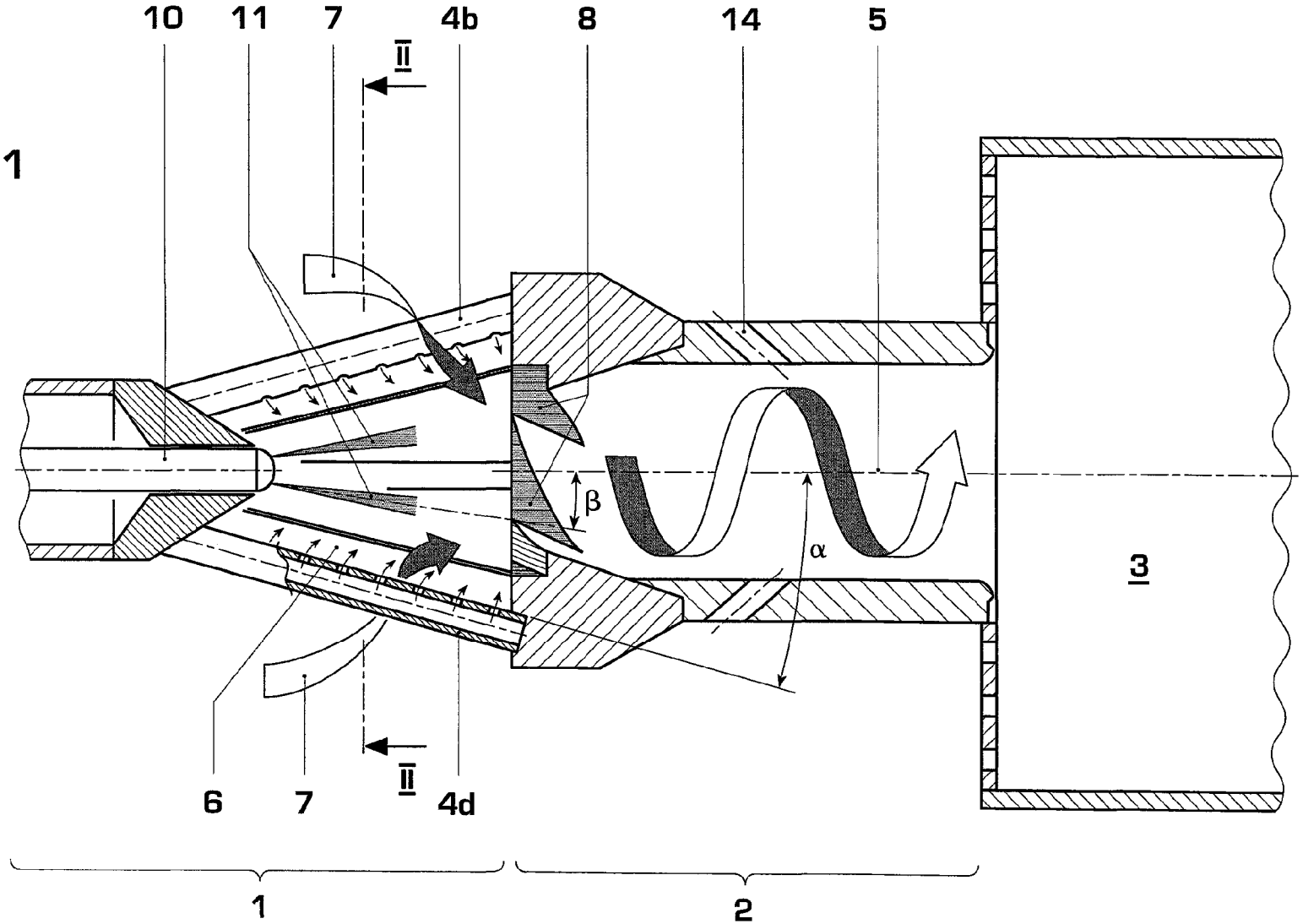
FIG. 1 shows a longitudinal section through a premix burner with a conical swirl generator and subsequent mixing section.

FIG. 1 shows a premix burner, for example for a gas turbine. It has a conical swirl generator 1 and a subsequent cylindrical mixing section 2, which expands into a combustion chamber space 3. In this example, the swirl generator 1 includes four interleaved cone parts 4*a*, 4*b*, 4*c*, 4*d*, of which cone parts 4*b* and 4*d* can be seen in FIG. 1. The individual longitudinal axes of the cone parts are in each case arranged offset with respect to one another and with respect to the longitudinal axis 5 of the swirl generator, as can be seen from FIG. 2. The cone parts 4*a-d* in each case run at an angle $\alpha$ with respect to the longitudinal axis 5 of the swirl generator 1. They in each case form spacers 6 between one another along their longitudinal edges, which spacers 6 are used for the introduction of compressed combustion air, the flow profile of which is indicated by the arrows 7. Metal sheets 8 are arranged at the outlet of the swirl generator 1 in order to form transition passages into the mixing section 2. A high-pressure atomiser nozzle 10 is arranged in the initial part of the conical swirl generator for introducing liquid fuel into the swirl generator 1. In accordance with the following FIGS. 3*a-c* and FIG. 4, this atomiser nozzle is designed in such a way as to produce an orientation of the spray cone 11 produced which is at an angle $\beta$ with respect to the longitudinal axis 5 of the swirl generator, the angle $\beta$ being smaller than the angle $\alpha$ or the half-angle of the cone parts of the swirl generator. This orientation of the spray cones prevents the walls of the swirl generator from being wetted by fuel oil droplets and prevents coking of the walls. In FIG. 1, further openings 14 for feeding air into the cylindrical mixing section 2 are arranged in the outer wall of the mixing section. These openings stabilize the flame and prevent flashbacks.

Figure 2:
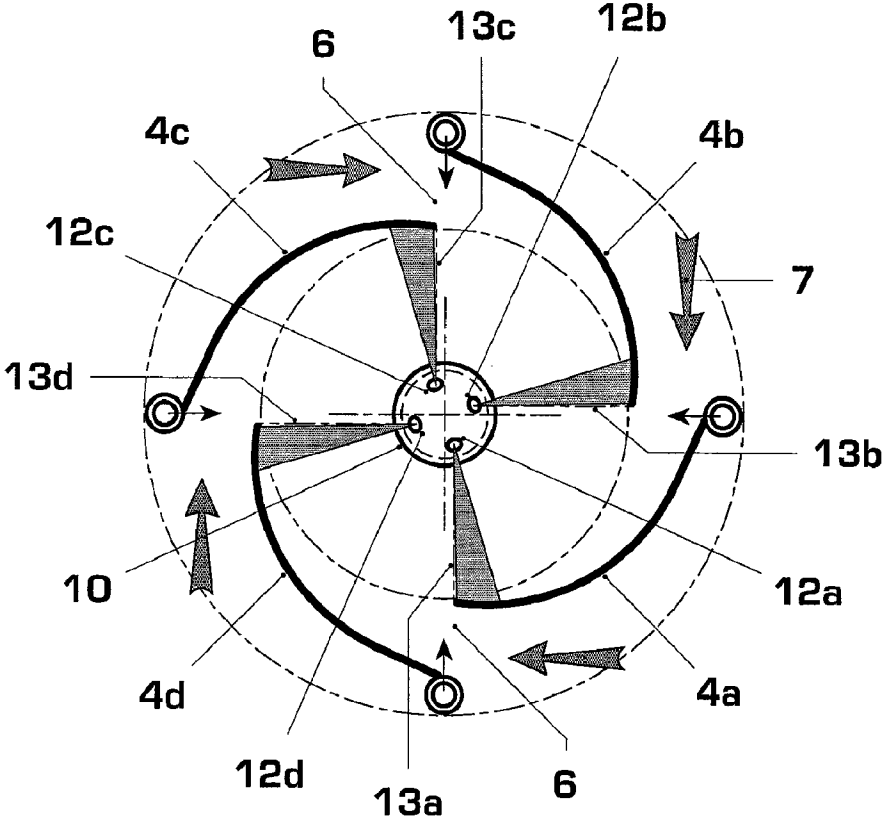
FIG. 2 shows a section through the premix burner and nozzle tip on line II-II in FIG. 1.

FIG. 2 shows, on cross section II-II, the swirl generator 1 with cone parts 4*a-d* and the high-pressure atomiser nozzle 10 arranged centrally on the longitudinal axis of the swirl generator. Arrows 7 indicate the incoming flow of air into the interior space of the swirl generator. On the nozzle 10, positions 12*a-d*, at which fuel emerges, are indicated off-center with respect to the longitudinal axis of the fuel nozzle 10. In the example shown, four opening positions are illustrated; by way of example, two or any desired greater number of positions are possible. The outlet openings are positioned in such a manner that the spray cone which emerges is directed toward the wake of the individual cone parts 4*a-d*. For this purpose, the outlet openings are each arranged on artificial lines 13*a-d* running at a right angle with respect to the tangent on the end part of the cone shells 4*a-d*. This positioning of the outlet openings and spray cones means that the spray cones are taken up by the incoming air flows 7 in such a way that the atomised fuel reaches a great depth of penetration in the premix burner. On the other hand, a different positioning of the spray cones would lead to the spray cones being picked up by the air flows earlier than with the orientation shown, so that they would tend to be diverted into the center of the premix burner, which leads to higher emission levels.

Figure 3B:
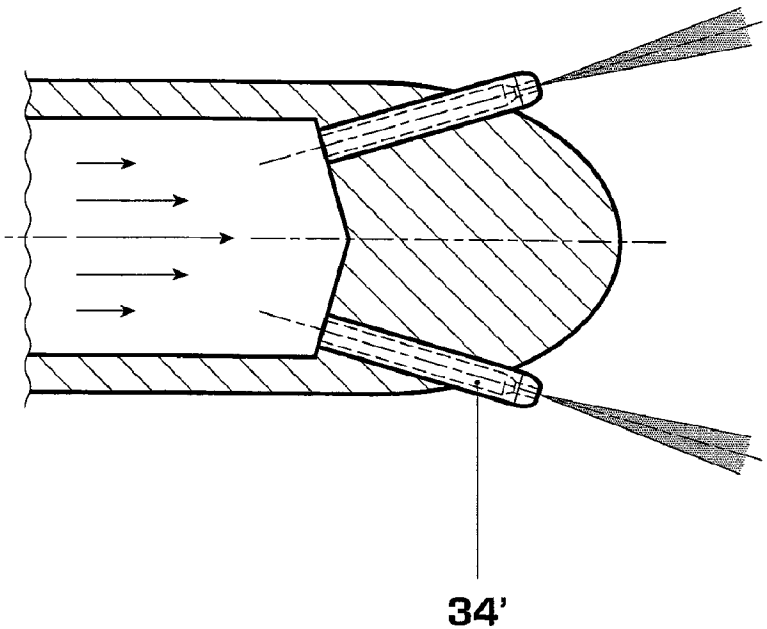
FIG. 3*b* shows a detail view of the internal geometry of the nozzle illustrated in FIG. 3*a*.
Figure 3A:
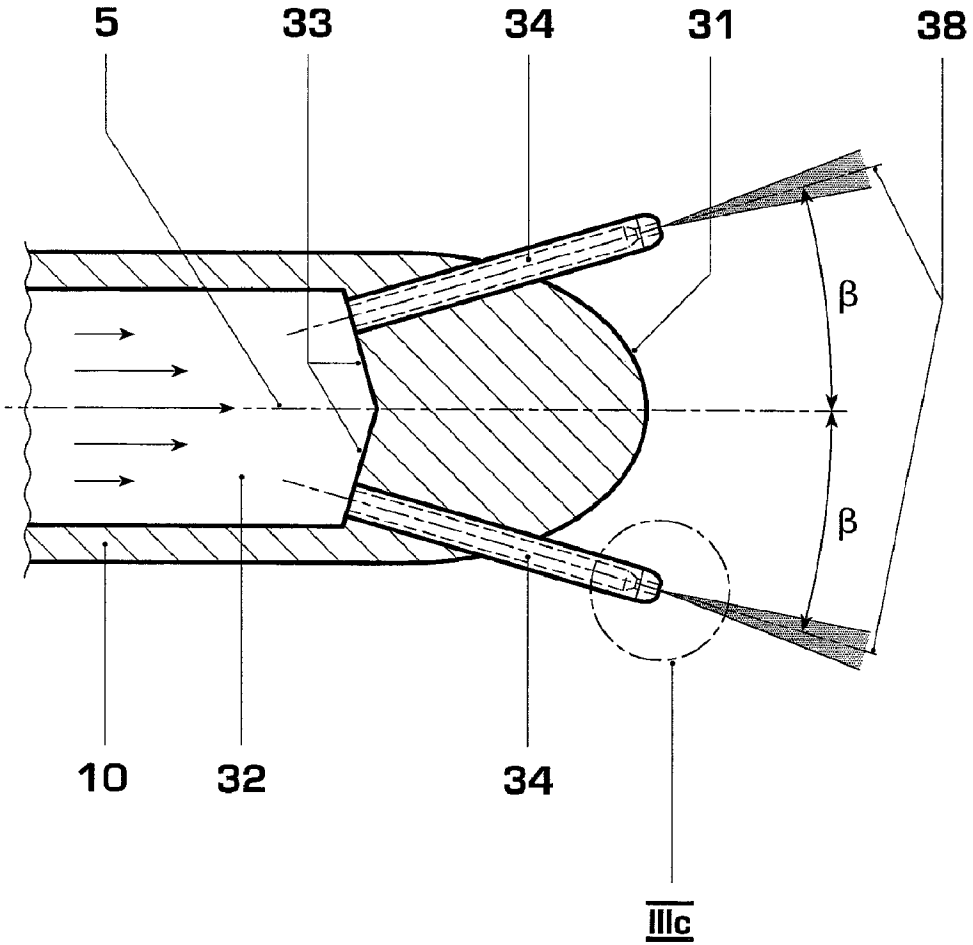
FIG. 3*a* shows a longitudinal section through a preferred embodiment of the nozzle according to the invention.

FIG. 3*a* shows a preferred high-pressure atomiser nozzle in accordance with the invention, with outer rounded tip 31 and an interior space 32 which has a conically shaped inner wall 33 toward the tip. From the interior space 32, two or more tubes 34 lead through the nozzle wall into the interior space of the swirl generator, the longitudinal axes 38 of the tubes 34 running at an angle $\beta$ with respect to the longitudinal axis 5 of the nozzle and of the swirl generator. In a first variant, the tubes 34 extend over a length which is such that they project beyond the tip of the nozzle. The outer wall of the end parts of the tubes are in each case preferably rounded in form.

FIG. 3*b* shows a variant in which two or more tubes 34' extend only just beyond the outer wall of the nozzle 10, so that they extend less far into the swirl generator than the nozzle tip itself.

In both variants, the nozzle tip is rounded in form. The flow of air which is introduced through inlet passages directly along the nozzle is positively influenced in the region of and downstream of the nozzle by this type of nozzle tip. In particular, recirculation of air in the region of the nozzle and downstream of the nozzle is reduced, with the result that the mixing of fuel and air is improved and the $NO_x$ emissions are reduced.

Figure 3C:
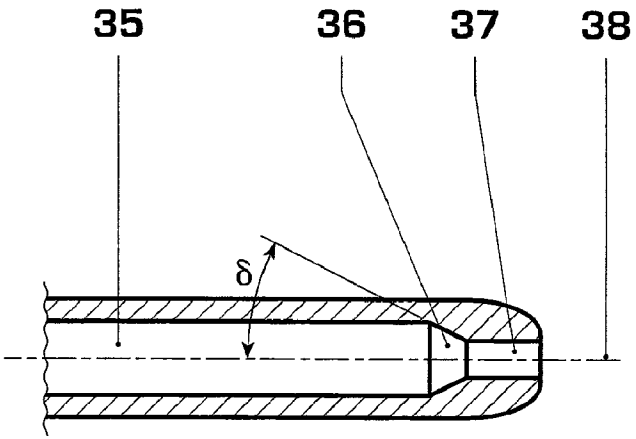
FIG. 3*c* shows a variant of the embodiment shown in FIG. 3*a*.

FIG. 3*c* shows a detail view of the internal geometry of the nozzle tubes 34. In an initial part, these tubes have a first cylindrical section 35, which leads away from the interior space of the nozzle. This is followed, as seen in the direction of flow, by a conically formed, narrowing transition section 36 with a cone half-angle $\delta$ of the wall of the narrowed section with respect to the longitudinal axis 38 of the tube of less than 45°, and this section expands into a second, narrower cylindrical section 37 with a smaller diameter. The length of the second cylindrical section 37 is preferably at most five times the diameter of the outlet opening.

Figure 4:
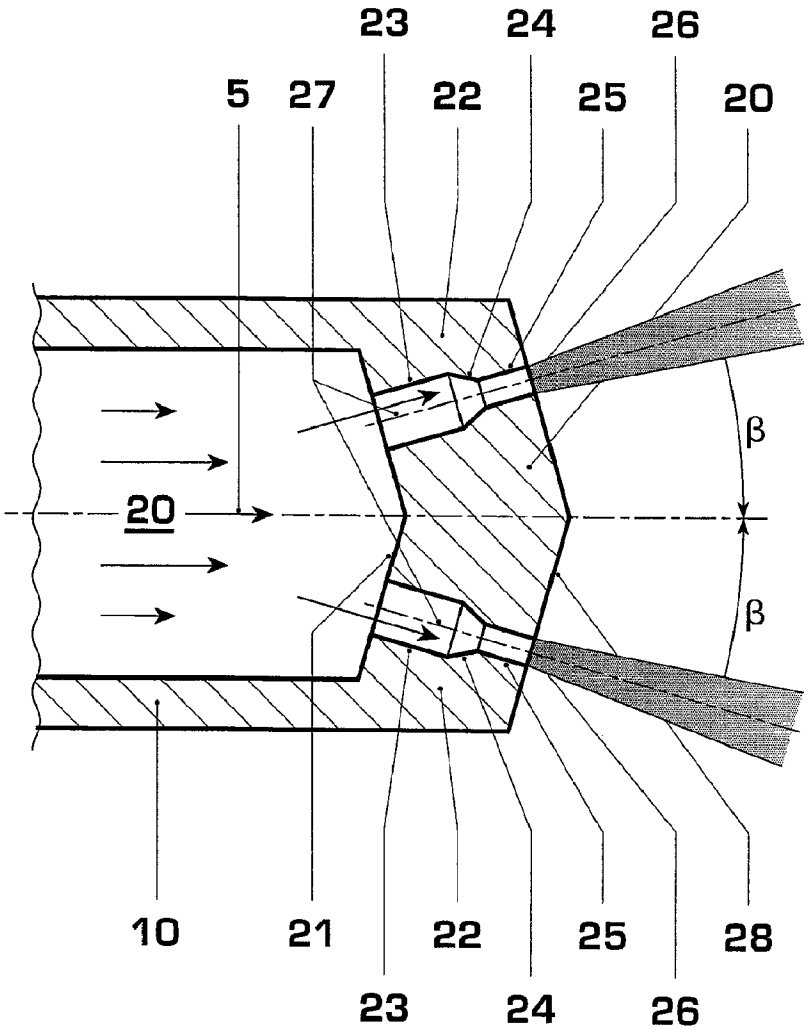
FIG. 4 shows a longitudinal section through a further embodiment of the high-pressure atomiser nozzle and its internal geometry.

A further embodiment of the fuel atomiser nozzle 10 in accordance with FIG. 4 has an interior space 20 which is conical in form as seen in the direction of flow toward the end of the nozzle. Two or more outlet passages 22, each with a first cylindrical section 23, a conically narrowed section 24 which follows the first cylindrical section 23 as seen in the direction of flow and a second, narrower cylindrical section 25, which ultimately expands to an outlet opening 26, lead from the conically pointed end wall 21 of the interior space 20. The arrows indicate the direction of flow of the liquid fuel. The longitudinal axes 27 of the outlet passages, which are the same as the longitudinal axes of the resulting spray cones, run at an angle β with respect to the longitudinal axis 5 of the nozzle and of the swirl generator. The outlet openings 26 are in particular arranged in the radially outer half of the nozzle. They preferably have a diameter of 0.5-1.5 mm. The nozzle tip 28 is externally conical in the embodiment shown.

Figure 5:
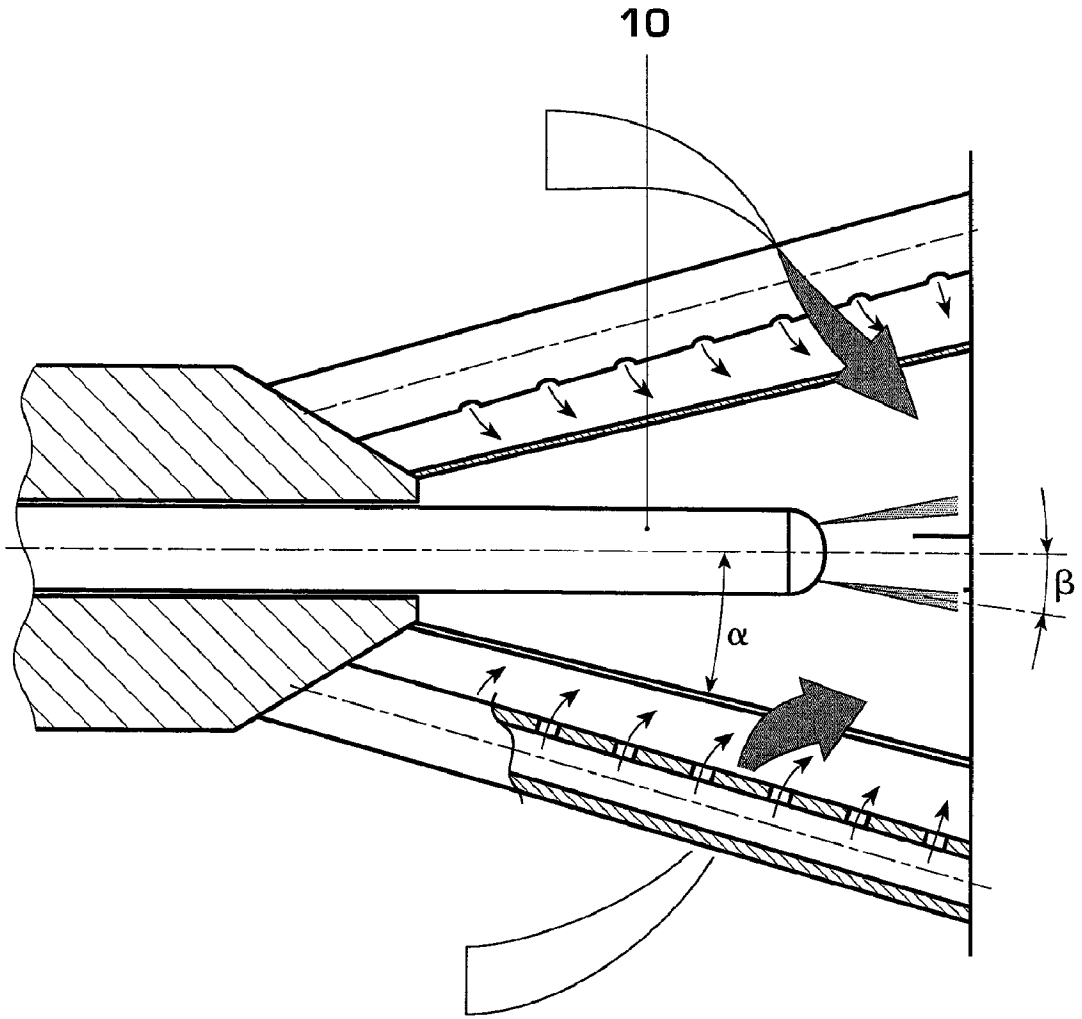
FIG. 5 shows a use of the nozzle in a premix burner with conical swirl generator without a subsequent mixing section.

FIG. 5 shows a use of the high-pressure atomiser nozzle according to the invention in a premix burner with a conical swirl generator, without a mixing section following the swirl generator, but rather the swirl generator instead expands directly into a combustion chamber. In particular, in this premix burner the atomiser nozzle extends as far as or beyond half the length of the interior space of the swirl generator. The nozzle in this case has one of the embodiments with outlet passages shown in FIGS. 3*a-c* and 4.

| List of Designations | |
|---|---|
| 1 | Swirl generator |
| 2 | Mixing section |
| 3 | Interior space of combustion chamber |
| 4a-4d | Cone parts of swirl generator |
| 5 | Longitudinal axis of swirl generator |
| 6 | Passages for incoming air flow |
| 7 | Airflow |
| 8 | Diverting parts |
| 10 | High-pressure fuel nozzle |
| 12a-d | Openings in nozzle tip |
| 13a-d | Artifical lines perpendicular to tangent on the end of the cone shells |
| 14 | Air inlet openings into mixing section |
| 20 | Interior space of nozzle conical tip part |
| 21 | Inner wall |
| 22 | Outlet passage |
| 23 | First cylindrical section |
| 24 | Conically narrowed section |
| 25 | Second cylindrical section |
| 26 | Outlet opening |
| 27 | Longitudinal axis of the outlet passage and spray cone |
| 28 | Conical nozzle tip |
| 31 | Rounded nozzle tip |
| 32 | Interior space of nozzle |
| 33 | Inner walls of the nozzle |
| 34, 34' | Tube |
| 35 | First cylindrical section |
| 36 | Conical transition section |
| 37 | Second cylindrical section |
| 38 | Longitudinal axis of the tube |
| 40 | Partition |
| 41 | Tip part of nozzle |
| 42 | Interior space of nozzle |
| 43 | Opening in partition |
| 44 | Feed section |
| 45 | Openings in nozzle tip |

While the invention has been described in detail with reference to exemplary embodiments thereof, it will be apparent to one skilled in the art that various changes can be made, and equivalents employed, without departing from the scope of the invention. The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments as are suited to the particular use contemplated. It is intended that the scope of the invention be defined by the claims appended hereto, and their equivalents. The entirety of each of the aforementioned documents is incorporated by reference herein.

What is claimed is:

1. A premix burner comprising:

a swirl generator comprising an interior space, cone shells, and defining a cone half angle α;

a mixing section which follows the swirl generator in the direction of flow;

passages configured and arranged to feed compressed combustion air into the swirl generator; and a high-pressure nozzle having an interior space and configured and arranged to atomise liquid fuel, at least one fuel passage configured and arranged to feed fuel into the nozzle interior space, the nozzle having at least two outlet passages which lead from the nozzle interior space to the interior space of the swirl generator and are arranged off center with respect to the longitudinal axis of the nozzle and are oriented so that spray cones when emerging from the outlet passages are directed onto the wake of the individual cone shells;

wherein the outlet passages are configured and arranged so that the spray cones when emerging each have a longitudinal axis running at an angle β with respect to the longitudinal axis of the swirl generator which is greater than zero and smaller than the cone half angle α of the swirl generator.

2. A premix burner comprising:

a swirl generator comprising an interior space, cone shells, and defining a cone half angle α;

a mixing section which follows the swirl generator in the direction of flow:

passages configured and arranged to feed compressed combustion air into the swirl generator: and a high-pressure nozzle having an interior space and configured and arranged to atomise liquid fuel, at least one fuel passage configured and arranged to feed fuel into the nozzle interior space, the nozzle having at least two outlet passages which lead from the nozzle interior space to the interior space of the swirl generator and are arranged off center with respect to the longitudinal axis of the nozzle and are oriented so that spray cones when emerging from the outlet passages are directed onto the wake of the individual cone shells;

wherein the outlet passages are configured and arranged so that the spray cones when emerging each have a longitudinal axis running at an angle β with respect to the longitudinal axis of the swirl generator which is smaller than the cone half angle α of the swirl generator;

wherein the angle β between the longitudinal axes of the spray cones and the longitudinal axis of the swirl generator is smaller than the cone half-angle α of the swirl generator and greater than 10°.

3. The premix burner as claimed in claim 2, wherein the angle β between the longitudinal axes of the spray cones and the longitudinal axis of the swirl generator is in the range from 10° to 18°.

4. The premix burner as claimed in claim 2, wherein the at least two outlet passages are arranged in a radially outer half of the nozzle with respect to the longitudinal axis of the nozzle and rotationally symmetrically with respect to the longitudinal axis of the nozzle.

5. The premix burner as claimed in claim 2, wherein the at least two outlet passages, as seen in the direction of flow of liquid fuel, each have a first cylindrical section, a conically narrowed section, and a second cylindrical section.

6. The premix burner as claimed in claim 5, wherein the at least two outlet passages each include a tube which projects beyond the tip of the nozzle.

7. The premix burner as claimed in claim 5, wherein the at least two outlet passages each include a tube which projects beyond an outer surface of the nozzle, a tip of the nozzle projecting further into the swirl generator than the tubes.

8. The premix burner as claimed in claim 5, wherein a half angle $\delta$ of the conically narrowed section between the wall of the conical section and the longitudinal axis of the at least two outlet passages is less than 45°.

9. The premix burner as claimed in claim 5, wherein each of the at least two outlet passages includes an outlet opening on an outer surface of the nozzle, and wherein the second cylindrical section in each case leads to an outlet opening.

10. The premix burner as claimed in claim 5, wherein the conically narrowed section has a cone half angle in the range from 30-45°.

11. The premix burner as claimed in claim 6, wherein the tip of the nozzle is rounded.

12. The premix burner as claimed in claim 6, wherein the tip of the nozzle is conical.

13. The premix burner as claimed in claim 5, wherein each of the at least two outlet passages includes an outlet opening on an outer surface of the nozzle, and wherein the length of the second cylindrical section is in each case at most five times the diameter of the outlet opening.

14. The premix burner as claimed in claim 2, wherein each of the at least two outlet passages includes an outlet opening on an outer surface of the nozzle, and wherein the outlet openings have a diameter in a range from 0.5 mm to 1.5 mm.

15. The premix burner as claimed in claim 2, further comprising:

openings for the admission of compressed air in the outer wall of the cylindrical mixing section.

16. A premix burner comprising:

a swirl generator which comprises cone shells and passages for feeding compressed combustion air into the swirl generator, the swirl generator defining an interior space and a cone half-angle $\alpha$;

a high-pressure nozzle configured and arranged to atomise liquid fuel, the nozzle including an interior space;

at least one fuel passage configured and arranged to feed fuel into the nozzle interior space;

wherein the nozzle includes at least two outlet passages configured and arranged to atomise fuel, the at least two outlet passages leading from the nozzle interior space to the interior space of the swirl generator and are arranged off-center with respect to the longitudinal axis of the nozzle;

wherein the at least one outlet passage is configured and arranged so that spray cones when emerging from the at least one outlet passage have a longitudinal axis running at an angle $\beta$ with respect to the longitudinal axis of the premix burner which is smaller than the cone half-angle $\alpha$ of the swirl generator, and the at least one outlet passage, as seen in the direction of flow of the liquid fuel, has a first cylindrical section, a conically narrowed section, and a second cylindrical section, and a tip of the nozzle extending to or beyond half the length of the interior space of the swirl generator.

* * * * *